US010539162B2

(12) United States Patent
Horii

(10) Patent No.: US 10,539,162 B2
(45) Date of Patent: Jan. 21, 2020

(54) HYDRAULIC SYSTEM FOR WORK MACHINE

(71) Applicant: KUBOTA CORPORATION, Osaka-shi (JP)

(72) Inventor: Hiroshi Horii, Sakai (JP)

(73) Assignee: KUBOTA CORPORATION, Osaki-Shi (JP)

( * ) Notice: Subject to any disclaimer, the term of this patent is extended or adjusted under 35 U.S.C. 154(b) by 225 days.

(21) Appl. No.: 15/387,548

(22) Filed: Dec. 21, 2016

(65) Prior Publication Data

US 2017/0184134 A1 Jun. 29, 2017

(30) Foreign Application Priority Data

Dec. 24, 2015 (JP) ..... 2015-252270

(51) Int. Cl.
*F15B 15/16* (2006.01)
*E02F 9/22* (2006.01)
(Continued)

(52) U.S. Cl.
CPC ..... *F15B 11/16* (2013.01); *E02F 3/425* (2013.01); *E02F 9/123* (2013.01); *E02F 9/22* (2013.01);
(Continued)

(58) Field of Classification Search
CPC ... E02F 3/425; E02F 9/123; E02F 9/22; E02F 9/2225; F15B 11/16; F15B 11/162
(Continued)

(56) References Cited

U.S. PATENT DOCUMENTS 5,048,293 A * 9/1991 Aoyagi ..... E02F 9/2235 60/420
5,079,919 A * 1/1992 Nakamura ..... E02F 9/2235 60/426
(Continued)

FOREIGN PATENT DOCUMENTS

CN 1670318 9/2005
CN 103161777 6/2013
(Continued)

OTHER PUBLICATIONS

Extended European Search Report for corresponding EP Application No. 16204950.6-1754, dated May 11, 2017.

*Primary Examiner* — Nathaniel E Wiehe
*Assistant Examiner* — Richard C Drake
(74) *Attorney, Agent, or Firm* — Mori & Ward, LLP

(57) ABSTRACT

A hydraulic system for a work machine includes a first control valve including a first direction switch to switch a direction in which the operation fluid is to flow through a first hydraulic actuator and a pressure compensator to maintain a differential pressure to a constant pressure, the differential pressure being a difference between a pressure of the operation fluid to be inputted to the pressure compensator and a pressure of the operation fluid to be outputted from the pressure compensator. And, the hydraulic system includes a second control valve including a second direction switch to switch a direction in which the operation fluid is to flow through a second hydraulic actuator and a flow rate prioritizer to prioritize a flow rate of the operation fluid to be outputted to the second hydraulic actuator.

11 Claims, 3 Drawing Sheets

(51) Int. Cl.

| | |
|---|---|
| ***E02F 9/12*** | (2006.01) |
| ***E02F 3/42*** | (2006.01) |
| ***F15B 11/16*** | (2006.01) |
| *E02F 3/32* | (2006.01) |
| *E02F 3/96* | (2006.01) |

(52) U.S. Cl.
CPC ..... *E02F 9/2225* (2013.01); *E02F 3/32* (2013.01); *E02F 3/964* (2013.01); *E02F 9/2296* (2013.01); *F15B 2211/35* (2013.01); *F15B 2211/7052* (2013.01); *F15B 2211/7058* (2013.01); *F15B 2211/71* (2013.01); *F15B 2211/78* (2013.01)

(58) Field of Classification Search
USPC ..... 60/420
See application file for complete search history.

(56) References Cited

U.S. PATENT DOCUMENTS 5,267,440 A * 12/1993 Nakamura ..... E02F 9/2232 60/426
5,347,811 A * 9/1994 Hasegawa ..... E02F 9/2225 60/426
5,394,696 A * 3/1995 Eich ..... E02F 9/22 60/420
5,481,875 A * 1/1996 Takamura ..... E02F 9/2235 60/443
5,752,384 A * 5/1998 Schmitt ..... F15B 11/16 60/426
5,937,645 A * 8/1999 Hamamoto ..... F15B 13/0417 60/422
6,076,350 A * 6/2000 Deininger ..... B62D 5/07 60/422
6,134,887 A * 10/2000 Bertotti ..... E02F 9/2225 60/422
6,367,365 B1 * 4/2002 Weickert ..... F15B 11/003 60/422
6,397,591 B1 * 6/2002 Tsuruga ..... E02F 3/325 60/422
6,408,622 B1 * 6/2002 Tsuruga ..... E02F 9/2207 60/422
7,240,771 B2 * 7/2007 Perkins ..... B66F 9/22 187/226
8,833,065 B2 * 9/2014 Kawasaki ..... E02F 9/2075 60/414
9,045,316 B2 * 6/2015 Wan ..... B66C 13/066
2014/0208734 A1 * 7/2014 Horii ..... F15B 7/003 60/420
2015/0240455 A1 * 8/2015 Takebayashi ..... E02F 9/2203 60/421
2015/0275468 A1 * 10/2015 Horii ..... E02F 3/425 60/428
2017/0121940 A1 * 5/2017 Kawaguchi ..... E02F 9/22

FOREIGN PATENT DOCUMENTS

| | | |
|---|---|---|
| CN | 104603468 | 5/2015 |
| EP | 1054162 | 11/2000 |
| GB | 2435501 | 8/2007 |
| JP | 04-136508 | 5/1992 |
| JP | 11-190303 | 7/1999 |
| JP | 2000-227103 | 8/2000 |
| JP | 2002-519596 | 7/2002 |
| JP | 2013-036276 | 2/2013 |
| WO | WO 2009/001377 | 12/2008 |

* cited by examiner

HYDRAULIC SYSTEM FOR WORK MACHINE

CROSS-REFERENCE TO RELATED APPLICATIONS

The present application claims priority under 35 U.S.C. § 119 to Japanese Patent Application No. 2015-252270, filed Dec. 24, 2015. The contents of this application are incorporated herein by reference in their entirety.

BACKGROUND OF THE INVENTION

Field of the Invention

The present invention relates to a hydraulic system for a work machine.

Discussion of the Background

A work machine described in Japanese Unexamined Patent Publication No. 2013-36276 is previously known. The work machine described in Japanese Unexamined Patent Publication No. 2013-36276 includes a variable displacement axial pump, a plurality of hydraulic actuators (a turn motor, a travel motor, an arm cylinder, a boom cylinder, and a bucket cylinder), and a plurality of control valves configured to control the plurality of hydraulic actuators. Each of the control valves is provided with a pressure compensation valve.

SUMMARY OF THE INVENTION

A hydraulic system for a work machine includes a first hydraulic actuator, a second hydraulic actuator, a hydraulic pump to supply an operation fluid, a first control valve to control the first hydraulic actuator, the first control valve including a first direction switch to switch a direction in which the operation fluid is to flow through the first hydraulic actuator and a pressure compensator to maintain a differential pressure to a constant pressure, the differential pressure being a difference between a pressure of the operation fluid to be inputted to the pressure compensator and a pressure of the operation fluid to be outputted from the pressure compensator. And, the hydraulic system includes a second control valve to control the second hydraulic actuator, the second control valve including a second direction switch to switch a direction in which the operation fluid is to flow through the second hydraulic actuator and a flow rate prioritizer to prioritize a flow rate of the operation fluid to be outputted to the second hydraulic actuator.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
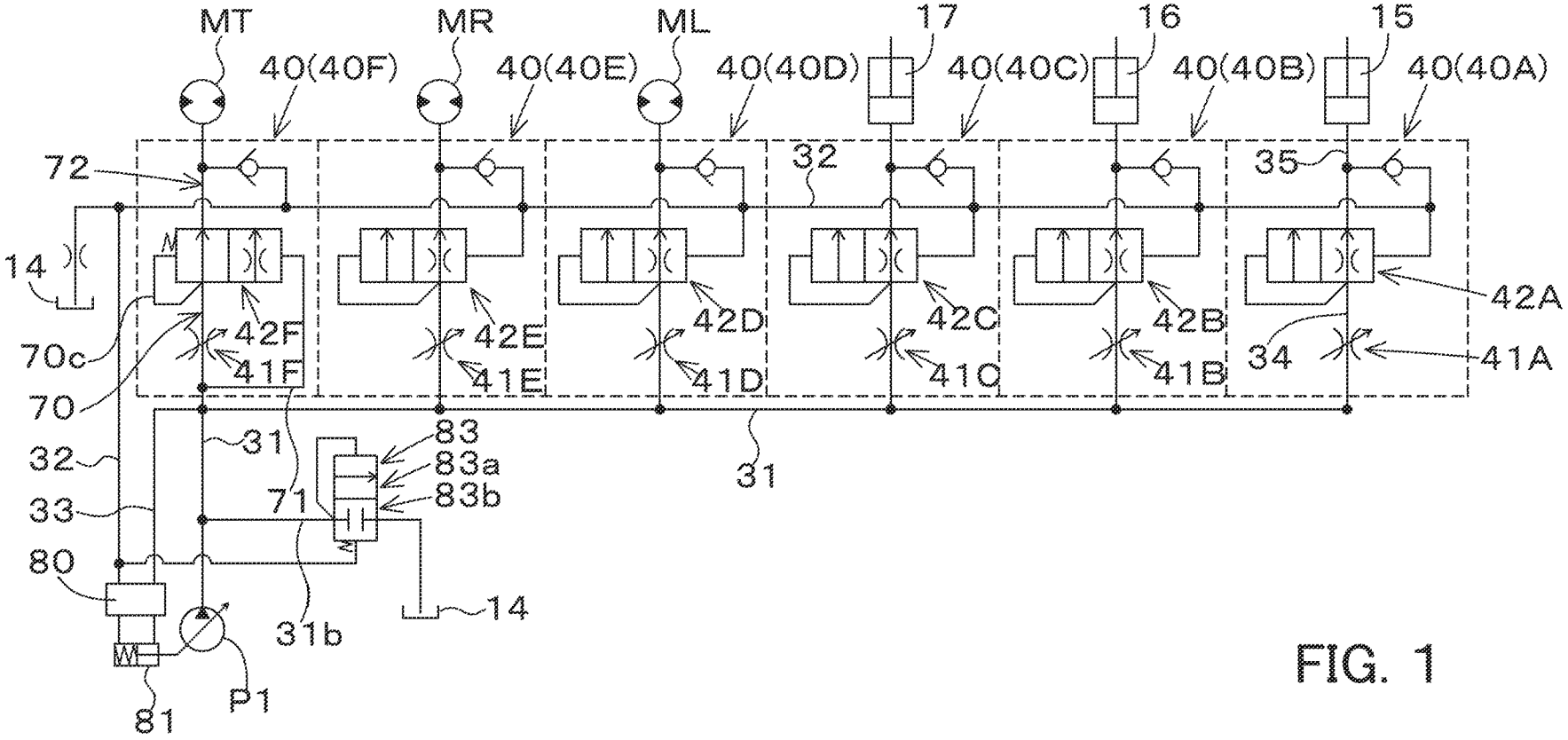
FIG. 1 is a view illustrating a hydraulic system (a hydraulic circuit) of a work machine according to an embodiment of the present invention.

The embodiment will now be described with reference to the accompanying drawings, wherein like reference numerals designate corresponding or identical elements throughout the various drawings. The drawings are to be viewed in an orientation in which the reference numerals are viewed correctly.

Referring to drawings, an embodiment of the present invention will be described below.

Figure 3:
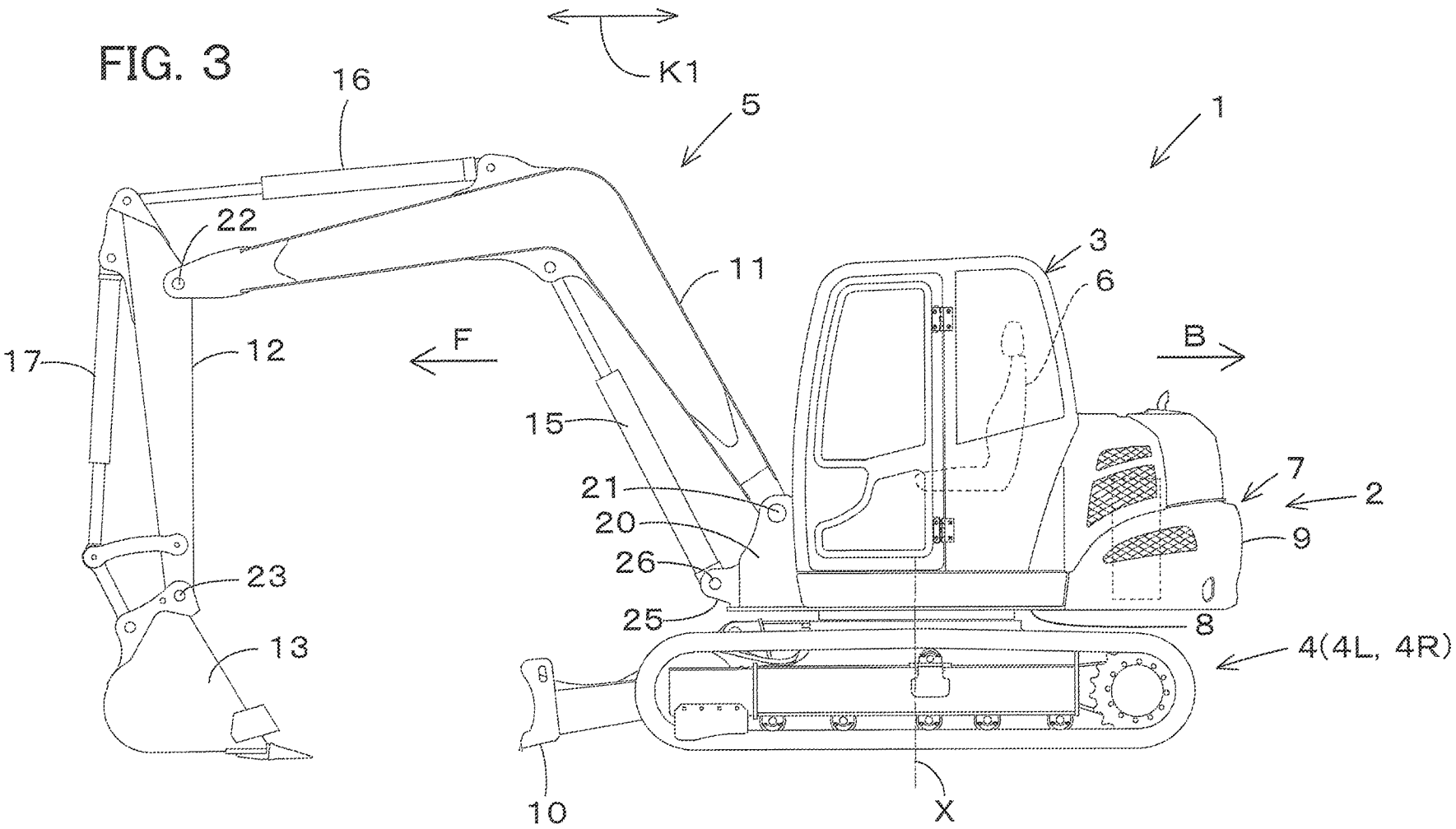
FIG. 3 is a view illustrating an overall of a backhoe according to the embodiment.

FIG. 3 is a schematic view illustrating an overall configuration of a work machine according to an embodiment of the present invention. In the embodiment, the work machine will be explained on the basis of a backhoe that is a turning work machine. The work machine is not limited to the backhoe, and accordingly may be a Skid Steer Loader (SSL), a Compact Track Loader (CTL), and a Tractor, for example.

The work machine 1 includes a machine body 2, a cabin 3, a travel device 4, and an operation device 5.

Hereinafter, in explanations of the embodiment of the present invention and in explanations of the modified examples of the embodiment, a forward direction (a direction shown by an arrowed line F in FIG. 3) corresponds to a front side of an operator seating on an operator seat 6 of the cabin 3, and a backward direction (a direction shown by an arrowed line B in FIG. 3) corresponds to a back side of the operator. In addition, a machine width direction corresponds to a horizontal direction that is a direction perpendicular to a front-back direction K1 (refer to FIG. 3).

The machine body 2 includes a turn base 7 supported on the travel device 4. The turn base 7 is supported on the travel device 4 by a turn bearing, and is capable of turning about a longitudinal axis X of the turn bearing, the longitudinal axis X extending vertically. The turn base 7 is turned by a motive power of a turn motor MT (refer to FIG. 1), the turn motor MT (referred to as a first hydraulic actuator or a second hydraulic actuator) being constituted of a hydraulic motor and the like. The turn base 7 includes a turn base plate 8 and a weight 9, the turn base plate 8 being configured to turn about the longitudinal axis X. The turn base plate 8 is formed of a steel plate and the like, and is coupled to the turn bearing.

The cabin 3 is mounted on one side portion (on the left side portion) of the turn base plate 8 in the machine width direction, that is, on the turn base plate 8. The operator seat 6, an operation device (not shown in the drawings), and the like are disposed inside the cabin 3. The travel device 4 includes a crawler device (a left crawler device) 4L disposed on the left and a crawler device (a right crawler device) 4R disposed on the right. As shown in FIG. 1, the left crawler device 4L includes a left travel motor ML (referred to as a first hydraulic actuator or a second hydraulic actuator) configured to drive a crawler. The right crawler device 4R includes a right travel motor MR (referred to as a first hydraulic actuator or a second hydraulic actuator) configured to drive another crawler. A dozer 10 is disposed on a front portion of the travel device 4.

The operation device 5 is attached to a front portion of the turn base 7. The operation device 5 includes a boom 11, an arm 12, and an operation tool 13. The operation device 5 further includes a boom cylinder 15, an arm cylinder 16, and an operation tool cylinder 17 as hydraulic actuators (referred to as a first hydraulic actuator or a second hydraulic actuator)

for the boom 11, the arm 12, and the operation tool 13. Each of the boom cylinder 15, the arm cylinder 16, and the operation tool cylinder 17 is constituted of a hydraulic cylinder.

A base portion of the boom 11 is pivotally supported by a first bracket (a support bracket) 20 disposed on a right front portion of the turn base plate 8, and is capable of turning about a lateral axis (an axis extending in the machine width direction) via a first axial shaft (a lateral shaft) 21. A tip end portion of the boom 11 is pivotally supported to be capable of turning about the lateral axis via a second axial shaft 22 disposed on a base portion of the arm 12. The operation tool 13 is pivotally supported by a tip end portion of the arm 12, and is capable of turning about the lateral axis via a third axial shaft 23.

In the embodiment, a bucket is attached as the operation tool 13. Instead of and in addition to the bucket 13, the operation tool 13 may be other operation tools (auxiliary attachments referred to as a first hydraulic actuator or a second hydraulic actuator) such as a breaker, an auger, a grapple, a mower.

The boom cylinder 15 is disposed between a second bracket 25 and an intermediate portion of the boom 11, the intermediate portion being intermediate in a length of the boom 11 in a longitudinal direction. The second bracket 25 is disposed on a front portion of the turn base plate 8. The second bracket 25 is provided with a fourth axial shaft (a lateral shaft) 26. The fourth axial shaft (a lateral shaft) 26 is configured to pivotally support a base end portion of the boom cylinder 15. When the boom cylinder 15 is stretched and shortened, the stretching and shortening swing the boom 11 about the first axial shaft 21. The arm cylinder 16 is disposed between a base portion of the arm 12 and an intermediate portion of the boom 11, the intermediate portion being intermediate in a length of the boom 11 in a longitudinal direction. When the arm cylinder 16 is stretched and shortened, the stretching and shortening swing the arm 12 about the second axial shaft 22. The operation tool cylinder 17 is disposed between the base portion of the arm 12 and a linkage member. When the operation tool cylinder 17 is stretched and shortened, the stretching and shortening swing the operation tool 13 about the third axial shaft 23.

Next, a hydraulic system for the work machine will be explained.

FIG. 1 illustrates a schematic overall view of the hydraulic system of the work machine. As shown in FIG. 1, the hydraulic system (a hydraulic circuit) includes a hydraulic pump P1. The hydraulic pump P1 is configured to discharge an operation fluid (an operation oil). The hydraulic pump P1 is a variable displacement axial pump. The hydraulic pump P1 is provided with a first hydraulic tube (first hydraulic path) 31 for feeding the hydraulic oil. A plurality of control valves 40 are connected to the first hydraulic tube 31. The plurality of control valves 40 are configured to control hydraulic actuators. The hydraulic actuators are devices configured to be operated by the operation fluid, and are, for example, hydraulic cylinders, hydraulic motors, and the like.

The hydraulic system for the work machine includes a first detection fluid tube (first detection fluid path) 32, a second detection fluid tube (second detection fluid path) 33, a flow rate compensation valve 80, and a swash plate control part (swash plate controller) 81.

The first detection fluid tube 32 (also referred to as a PLS fluid tube (PLS fluid path)) is connected to the plurality of control valves 40 and is also connected to the flow rate compensation valve 80. The first detection fluid tube 32 transmits a "PLS signal pressure" that is the highest load pressure of load pressures of the control valves 40. The second detection fluid tube 33 (also referred to as a PPS fluid tube (PPS fluid path)) connects the flow rate compensation valve 80 to a discharge side of the hydraulic pump P1. The second detection fluid tube 33 transmits a "PPS signal pressure" that is a discharge pressure of the operation fluid from the hydraulic pump P1.

The swash plate control part 81 is a device including a piston, a housing portion, and a rod. The piston is moved by a pressure. The housing portion houses the piston. The rod is coupled to the piston. One end side of the housing portion is connected to the flow rate compensation valve 80, and the other end side of the housing portion is connected to the discharge side of the hydraulic pump P1. The rod of the swash plate control part 81 (a moving portion) is connected to a swash plate of the hydraulic pump P1. Stretching and shortening of the rod change an angle of the swash plate.

The flow rate compensation valve 80 is a valve capable of controlling the swash plate control part 81 on the basis of the PLS signal pressure and the PPS signal pressure. The flow rate compensation valve 80 applies a pressure to one end side of the swash plate control part 81, and thereby maintains a pressure difference (a first differential pressure) between the PPS signal pressure and the PLS signal pressure so as to be a pressure preliminarily determined. That is, the flow rate compensation valve 80 stretches and shortens the rod disposed on the other end side of the swash plate control part 81, and thereby maintains the pressure difference (the first differential pressure) between the PPS signal pressure and the PLS signal pressure so as to be constant.

As described above, the angle of the swash plate is changed to maintain the first differential pressure to be constant, and thus a discharge amount of the hydraulic pump P1 can be adjusted on the basis of the load pressure. The hydraulic system includes an unload valve 83. The unload valve 83 is connected to a branched fluid tube (branched fluid path) 31*b* branched from the first fluid tube 31. The unload valve 83 is capable of being switched to a first position 83*a* and a second position 83*b*. The first position 83*a* allows the operation fluid of the first fluid tube 31 (the branched fluid tube 31*b*) to be discharged to an operation fluid tank 14. The second position 83*b* allows the branched fluid tube 31*b* to be closed. The unload valve 83 is switched depending on the highest load pressure of and the discharge pressure of the hydraulic pump P1, the highest load pressure and the discharge pressure each being inputted to the unload valve 83.

The plurality of control valves 40 will be explained below.

The plurality of control valves 40 include a boom control valve 40A, an arm control valve 40B, an operation control valve 40C, a first travel control valve 40D, a second travel control valve 40E, and a turn control valve 40F. The boom control valve 40A is configured to control the boom cylinder 15. The arm control valve 40B is configured to control the arm cylinder 16. The operation control valve 40C is configured to control the operation tool cylinder 17. The first travel control valve 40D is configured to control the left travel motor ML. The second travel control valve 40E is configured to control the right travel motor MR. The turn control valve 40F is configured to control the turn motor MT. The plurality of control valves 40 are not limited to the control valves mentioned in the embodiment.

Figure 2A:
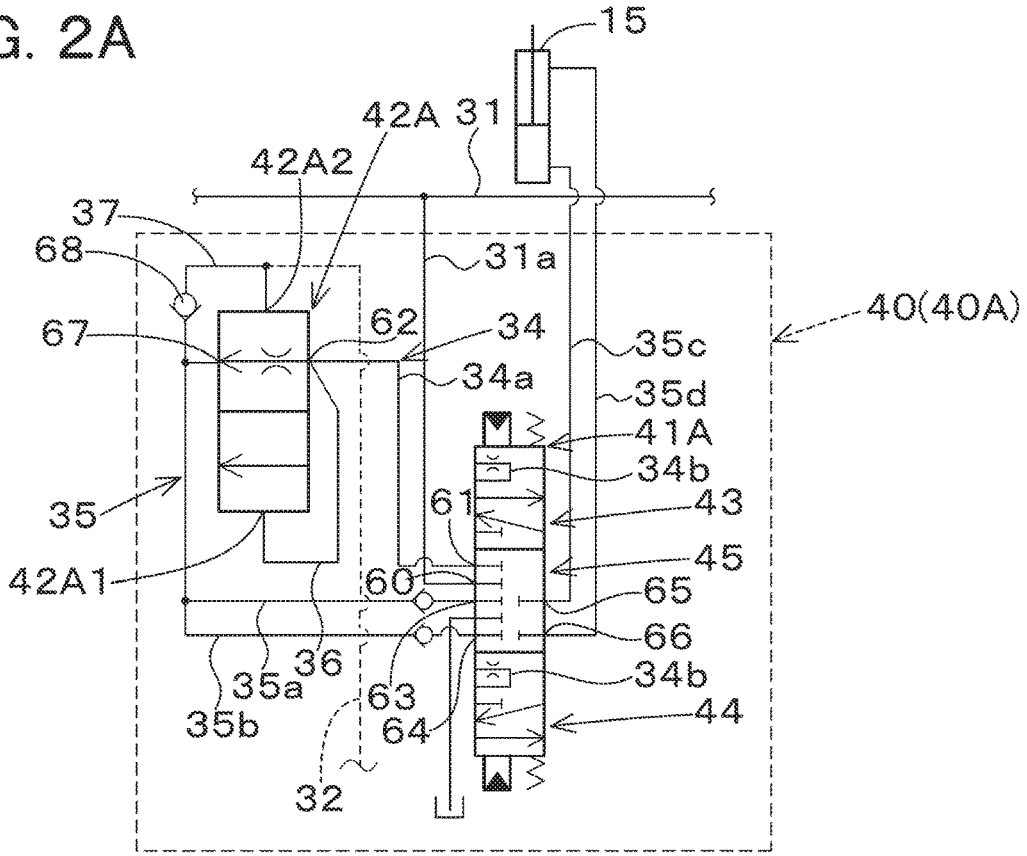
FIG. 2A is a view illustrating a detailed circuit of a control valve having a pressure compensator according to the embodiment.
Figure 2B:
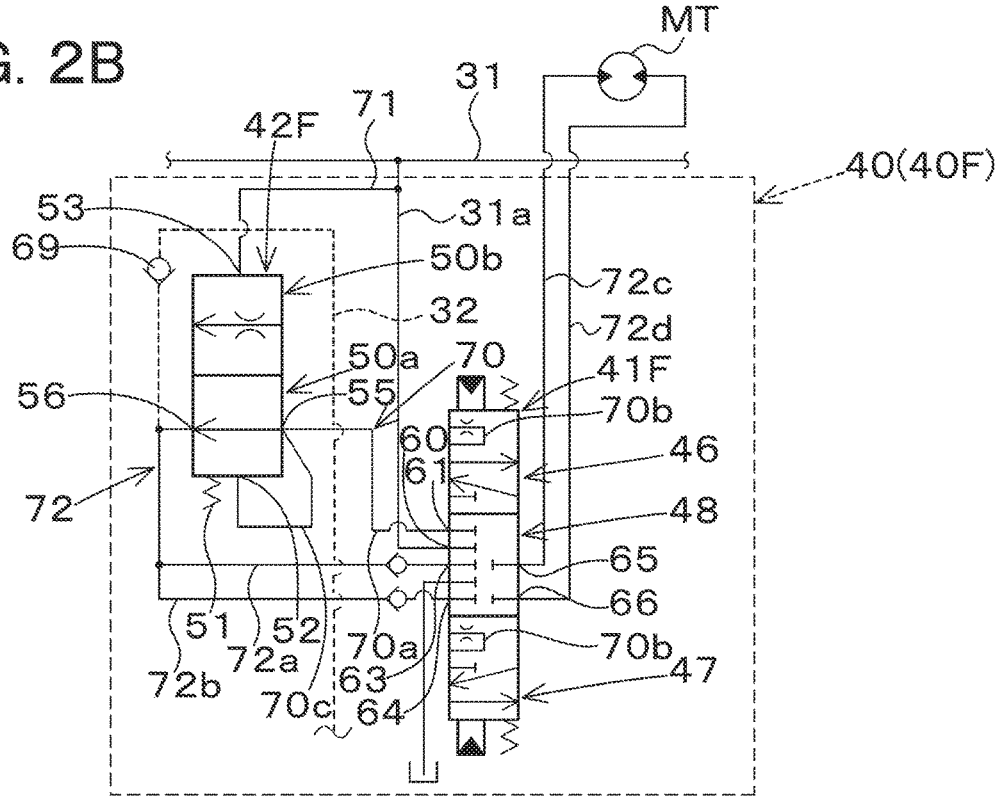
FIG. 2B is a view illustrating a detailed circuit of a control valve having a flow rate prioritizer according to the embodiment.

As described in FIG. 1 and FIG. 2, the boom control valve 40A includes a first direction switch part (first direction switch) 41A and a pressure compensation part (a pressure compensator) 42A. The first direction switch part 41A is configured to switch a direction of the operation fluid supplied to the boom cylinder 15, and is, for example, a three-position switch valve configured to be switched to a first position 43, a second position 44, and a third position (neutral position) 45. In a case where the first direction switch part 41A is in the first position 43, the first direction switch part 41A is switched to a direction allowing the operation fluid to be fed to a bottom side of the boom cylinder 15 and a direction allowing the operation fluid (return fluid) to be discharged to an operation fluid tank, the operation fluid (return fluid) returning from a rod side of the boom cylinder 15. In a case where the first direction switch part 41A is in the second position 44, the first direction switch part 41A is switched to a direction allowing the operation fluid (return fluid) to be discharged to the operation fluid tank, the operation fluid (return fluid) returning from the bottom side of the boom cylinder 15 and a direction allowing the operation fluid to be fed to the rod side of the boom cylinder 15. In a case where the first direction switch part 41A is in the third position 45, the first direction switch part 41A does not feed the operation fluid to the boom cylinder 15.

The first direction switch part 41A is switched by an operation of a operation member disposed around the operator seat 6 and the like. For example, the hydraulic system includes another hydraulic pump (referred to as a pilot pump) in addition to the hydraulic pump P1, the hydraulic pump (the pilot pump) being configured to discharge an operation fluid (a pilot fluid) used for control and signal. The pilot pump is connected to a remote control valve through a fluid tube (fluid path), the remote control valve being configured to vary a pressure on the basis of the operation of the operation member; thus the pilot pressure based on the operation is outputted from the remote control valve and is applied to a pressure reception part of the first direction switch part 41. The pilot pressure applied to the pressure reception part of the first direction switch part 41 switches the position of the first direction switch part 41. In the example described above, the pilot pressure switches the position of the first direction switch part 41A; however, the position of the first direction switch part 41A may be switched by an electric power (for example, an electric current) applied to the first direction switch part 41A.

A pump port 60 included in the first direction switch part 41A is connected to the branched fluid tube 31*a* branched from the first fluid tube 31. The branched fluid tube 31*a* supplies the operation fluid to the first direction switch part 41A, the operation fluid being discharged from the hydraulic pump P1. The first direction switch part 41A and the second direction switch part 42A are connected to each other by a connecting fluid tube (connecting fluid path) 34. The connecting fluid tube 34 includes a first connecting fluid tube 34*a* and a second connecting fluid tube 34*b*. The first connecting fluid tube 34*a* is a fluid tube (fluid path) connecting a first output port 61 of the first direction switch part 41A to an input port 62 of the pressure compensation part 42A. The second connecting fluid tube 34*b* is a fluid tube (fluid path) connecting the pump port 60 of the first direction switch part 41A to the first output port 61 of the first direction switch part 41A. The second connecting fluid tube 34*b* is formed in the first direction switch part 41A.

The pressure compensation part 42A and the boom cylinder 15 are connected to each other by a connecting fluid tube (connecting fluid path) 35. The connecting fluid tube 35 includes a first connecting fluid tube 35*a*, a second connecting fluid tube 35*b*, a third connecting fluid tube 35*c*, and a fourth connecting fluid tube 35*d*. The first connecting fluid tube 35*a* is a fluid tube (fluid path) connecting an output port 67 of the pressure compensation part 42A to a first input port 63 of the first direction switch part 41A. The second connecting fluid tube 35*b* is a fluid tube (fluid path) connecting the output port 67 of the pressure compensation part 42A to a second input port 64 of the first direction switch part 41A. The third connecting fluid tube 35*c* is a fluid tube (fluid path) connecting a second output port 65 of the first direction switch part 41A to a port of the bottom side of the boom cylinder 15. The fourth connecting fluid tube 35*d* is a fluid tube (fluid path) connecting a third output port 66 of the first direction switch part 41A to a port of the rod side of the boom cylinder 15. The output port 67 of the pressure compensation part 42A is connected to the first detection fluid tube 32 via a check valve 68.

The pressure compensation part 42A is a pressure compensation valve. The pressure compensation part 42A sets a differential pressure to be in a preliminarily determined range (to be a preliminarily determined value), the differential pressure being generated between a pressure of the operation fluid inputted to the pressure compensation part 42A and a pressure of the operation fluid to be outputted from the pressure compensation part 42A. In other words, the pressure compensation part 42A maintains a differential pressure to be constant, the differential pressure being generated between in front of and behind a spool of the first direction switch part 41A (a differential pressure between a pressure of the operation fluid on an upper stream side and a pressure of the operation fluid on a downstream side), and thereby the pressure compensation part 42A branches the operation fluid so that the operation fluid has an amount based on an operation amount of the operation member. For details, the pressure compensation part 42A includes a pressure reception part (pressure receptor) 42A1 and a pressure reception part (pressure receptor) 42A2. The pressure reception part 42A1 is configured to receive a pressure of the operation fluid inputted to the input port 62. The pressure reception part 42A2 is configured to receive a pressure of the operation fluid to be outputted from the output port 67. The input port 62 and the pressure reception part 42A1 are connected to each other by a connecting fluid tube 36. The output port 67 and the pressure reception part 42A2 are connected to each other by a connecting fluid tube 37.

In this manner, the pressure of the operation fluid outputted from the first direction switch part 41A to the pressure compensation part 42A is applied to the pressure reception part 42A1, and the pressure of the operation fluid to be outputted from the output port 67 of the pressure compensation part 42A is applied to the pressure reception part 42A2. Then, the spool of the pressure compensation part 42A moves depending on the pressure difference between both of the operation fluids, and thus the pressure compensation part 42A varies an opening area.

As shown in FIG. 1, the arm control valve 40B includes a first direction switch part (first direction switch) 41B and a pressure compensation part (pressure compensator) 42B. The operation control valve 40C includes a first direction switch part (first direction switch) 41C and a pressure compensation part (pressure compensator) 42C. The first travel control valve 40D includes a first direction switch part (first direction switch) 41D and a pressure compensation part (pressure compensator) 42D. The second travel control valve 40E includes a first direction switch part (first direction switch) 41E and a pressure compensation part (pressure compensator) 42E. The first direction switch part 41B, the first direction switch part 41C, the first direction switch part 41D, and the first direction switch part 41E are three-position switch valves. And thus, the hydraulic actuators are controlled in a method same as the method of the first direction switch part 41A described above. The explanation of the controls is omitted.

The pressure compensation part 42B, the pressure compensation part 42C, the pressure compensation part 42D, and the pressure compensation part 42E are pressure compensation valves. And thus, the differential pressure generated between a pressure of the operation fluid inputted to the pressure compensation valve and a pressure of the operation fluid to be outputted from the pressure compensation valve is set to be in a preliminarily determined range in a method same as the method of the pressure compensation part 42A described above. The explanation of the setting is omitted. In addition, the first fluid tube 31, the first direction switch parts 41B, 41C, 41D, and 41E, the pressure compensation parts 42B, 42C, 42D, and 42E, and the hydraulic actuators (the arm cylinder 16, the operation tool cylinder 17, the left travel motor ML, and the right travel motor MR) are connected in a method same as the methods of the first direction switch part 41A and the pressure compensation part 42A. The explanation of the connections is omitted. That is, configurations of the connecting fluid tubes 34 (the first connecting fluid tube 34*a* and the second connecting fluid tube 34*b*), the connecting fluid tubes 35 (the first connecting fluid tube 35*a*, the second connecting fluid tube 35*b*, the third connecting fluid tube 35*c*, and the fourth connecting fluid tube 35*d*), the connecting fluid tube 36, and the connecting fluid tube 37 are capable of being applied to the control valves (the arm control valve 40B, the operation control valve 40C, the first travel control valve 40D, and the second travel control valve 40E) other than the boom control valve 40A. The explanation of the configurations is omitted.

As described above, the hydraulic system controls a discharge rate of the hydraulic pump P1 on the basis of the highest load pressure in the operation of the hydraulic actuators. On the other hand, the pressure compensation parts described above compensate the pressures of the operation fluids to be supplied to the hydraulic actuators. The hydraulic system according to the embodiment is capable of prioritizing a flow rate of the operation fluid to be supplied to the hydraulic actuator. For convenience of explanation, a control valve having a pressure compensation part configured to compensate a pressure of the operation fluid may be referred to as a "first control valve", and a control valve capable of prioritizing the flow rate of the operation fluid may be referred to as a "second control valve". In the embodiment, the boom control valve 40A, the arm control valve 40B, the operation control valve 40C, the first travel control valve 40D, and the second travel control valve 40E serve as the first control valve. The turn control valve 40F serves as the second control valve.

As shown in FIG. 1 and FIG. 2, the turn control valve 40F includes a second direction switch part (second direction switch) 41F and a flow rate prioritizing part (flow rate prioritizer) 42F. The second direction switch part 41F is configured to switch a direction of the operation fluid flowing to the turn motor MT, and is, for example, a three-position switch valve configured to be switched to a first position 46, a second position 47, and a third position (neutral position) 48.

In a case where the second direction switch part 41F is in the first position 46, the second direction switch part 41F is switched to a direction allowing the operation fluid to be fed to one side of the turn motor MT and a direction allowing the operation fluid (return fluid) to be discharged to the operation fluid tank, the operation fluid (return fluid) returning from the other side of the turn motor MT.

In a case where the second direction switch part 41F is in the second position 47, the second direction switch part 41F is switched to a direction allowing the operation fluid to be fed to the other side of the turn motor MT and a direction allowing the operation fluid (return fluid) to be discharged to the operation fluid tank, the operation fluid (return fluid) returning from the one side of the turn motor MT.

In a case where the second direction switch part 41F is in the third position 48, the second direction switch part 41F does not feed the operation fluid to the turn motor MT. The second direction switch part 41F is switched by an operation of an operation member disposed around the operator seat 6 and the like.

The flow rate prioritizing part 42F is a valve configured to move a spool to prioritize a flow rate of the operation fluid to be outputted to the hydraulic actuator. The spool of the flow rate prioritizing part 42F is capable of moving between a first position 50*a* and a second position 50*b*. The first position 50*a* is a position allowing a flow rate of the operation fluid to be increased, the operation fluid being to be outputted from the second direction switch part 41F. The second position 50*b* is a position allowing the flow rate of the operation fluid to be reduced, the operation fluid being to be outputted from the second direction switch part 41F.

That is, the flow rate of the operation fluid of the case where the flow rate prioritizing part 42F is in the first position 50*a* is larger than a flow rate of the operation fluid at an intermediate position between the first position 50*a* and the second position 50*b*, and the flow rate of the operation fluid of the case where the flow rate prioritizing part 42F is in the second position 50*b* is smaller than the flow rate of the operation fluid at the intermediate position.

The flow rate prioritizing part 42F includes a pressing member 51, a first pressure reception part 52, and a second pressure reception part 53. The pressing member 51 is disposed on a side close to the first position 50*a*. The pressing member 51 presses the spool of the flow rate prioritizing part 42F toward the first position 50*a*, that is, an opening side. The pressing member 51 is, for example, constituted of a spring.

Regarding the pressing member 51 (the spring 52), a force pressing the spool toward the first position 50*a*, that is, a set pressure (a second differential pressure) of the flow rate prioritizing part 42F in fully stroking the spool (at the maximum area) is set to be equal to or less than a first differential pressure that is a differential pressure between the PPS signal pressure and the PLS signal pressure.

The flow rate outputted from the flow rate prioritizing part 42F may be larger than the flow rate at a solo operation of the hydraulic actuator when the set pressure in the flow rate prioritizing part 42F (the set pressure by the spring 51) exceeds the first differential pressure.

In this embodiment, the pressing member 51 is constituted of a spring to press the spool toward the first position 50*a*. However, the spool may be pressed by a pressure of the operation fluid (a pressure of the pilot fluid). For example, the flow rate prioritizing part 42F can be provided with a pressure reception part such as a control pin used for pressing the spool, and in this manner, the pilot pressure can be applied to the pressure reception part.

The pilot pressure to be applied to the pressure reception part may be a pressure of the remote control valve that varies the pilot pressure in accordance with an operation of the operation member, and may be a pressure obtained by depressurizing the pressure of the remote control valve with a depressurizing valve.

The first pressure reception part 52 is configured to receive a pressure of the operation fluid outputted from the second direction switch part 41F. The second pressure reception part 53 is configured to receive a pressure of the operation fluid discharged from the hydraulic pump P1 to the turn control valve 40F. In other words, the second pressure reception part 53 is configured to receive a pressure of the operation fluid on an upper steam side of the spool of the second direction switch part 41F.

The flow rate prioritizing part 42F and the second direction switch part 41F are connected to each other by a connecting fluid tube (second fluid tube) 70. The connecting fluid tube (second fluid tube) 70 includes a first connecting fluid tube (first connecting fluid path) 70*a* and a second connecting fluid tube (second connecting fluid path) 70*b*, and a third connecting fluid tube (third connecting fluid path) 70*c*.

The first connecting fluid tube 70*a* is a fluid tube (fluid path) connecting a first output port 61 of the second direction switch part 41F to an input port 55 of the flow rate prioritizing part 42F.

The second connecting fluid tube 70*b* is a fluid tube (fluid path) connecting a pump port 60 of the second direction switch part 41F to the first output port 61 of the second direction switch part 41F. The second connecting fluid tube 70*b* is formed in the second direction switch part 41F. The third connecting fluid tube 70*c* is a fluid tube (fluid path) connecting the input port 55 of the flow rate prioritizing part 42F to the first pressure reception part 52.

The first hydraulic tube 31 and the second pressure reception part 53 of the flow rate prioritizing part 42F are connected to each other by a connecting hydraulic tube (third hydraulic tube) 71. In particular, the connecting hydraulic tube (third hydraulic tube) 71 is a hydraulic tube connecting the branched hydraulic tube 31*a* of the first hydraulic tube 31 to the second pressure reception part 53.

The flow rate prioritizing part 42F and the turn motor MT are connected to each other by a connecting hydraulic tube 72. The connecting hydraulic tube 72 includes a first connecting hydraulic tube 72*a*, a second connecting hydraulic tube 72*b*, a third connecting hydraulic tube 72*c*, and a fourth connecting hydraulic tube 72*d*.

The first connecting hydraulic tube 72*a* is a hydraulic tube connecting the output port 56 of the flow rate prioritizing part 42F to the first input port 63 of the second direction switch part 41F.

The second connecting hydraulic tube 72*b* is a hydraulic tube connecting the output port 56 of the flow rate prioritizing part 42F to the second input port 64 of the second direction switch part 41F.

The third connecting hydraulic tube 72*c* is a hydraulic tube connecting the second output port 65 of the second direction switch part 41F to a port of one side of the turn motor MT.

The fourth connecting hydraulic tube 72*d* is a hydraulic tube connecting the third output port 66 of the second direction switch part 41F to a port of the other side of the turn motor MT.

The output port 56 of the flow rate prioritizing part 42F is connected to the first detection fluid tube 32 via a check valve 69.

The spool of the flow rate prioritizing part 42F accordingly is pressed to the first position 50*a* by a pressure of the operation fluid, the pressure being received by the first pressure reception part 52, (a pressure of the operation fluid outputted from the first output port 61 of the second direction switch part 41F) and by the pressing member 51. In addition, the spool is pressed to the second position 50*b* by a pressure of the operation fluid, the pressure being received by the second pressure reception part 53, (a pressure of the operation fluid on an upper stream side of the spool of the second direction switch part 41F).

As described above, according to the hydraulic system, in a multi operation where the boom cylinder 15, the arm cylinder 16, and the turn motor MT are operated at the same time, a flow rate outputted from the flow rate prioritizing part 42F is set to be constant. For example, it is supposed that a load pressure of the boom cylinder 15 in operation is 10 MPa, a load pressure of the arm cylinder 16 in operation is 5 MPa, a load pressure of the turn motor MT in operation is 3 MPa, and the set pressure of the flow rate compensation valve 80 is 1.4 MPa. In that case, the highest load pressure of the operation fluid is 10 MPa, and a pressure of the operation fluid discharged from the hydraulic pump P1 is 11.4 MPa. Here, supposing that the set pressure in the flow rate prioritizing part 42F is 1.0 MPa, the spool of the flow rate prioritizing part 42F moves to vary the opening area of the flow rate prioritizing part 42F, and thereby the set pressure is maintained to 1.0 MPa. Thus, a flow rate outputted from the flow rate prioritizing part 42F is set to be constant.

In other words, a differential pressure between in front of and behind the second direction switch part 41F is set to 1.0 MPa by the flow rate prioritizing part 42F (the flow rate prioritizing part 42F generates a pressure loss of 1.0 MPa), the operation fluid can be supplied preferentially to the turn motor MT regardless of the loads of the boom cylinder 15 and the arm cylinder 16.

Accordingly, a flow rate of the operation fluid to be outputted from a preliminarily determined control valve can be sufficiently obtained even in the work machine having a pressure compensation part. In particular, the operation fluid can be supplied to the hydraulic actuator without a conventional priority valve.

In addition, in a configuration of a single pump LS (load sensing system) where a single hydraulic pump P1 operates the plurality of hydraulic actuators, differentiation of a turn speed between the solo operation and the multi operation can be reduced.

Also in a configuration of two pump LSs where two hydraulic pumps P1 operate the plurality of hydraulic actuators, differentiation of a turn speed between the solo operation and the multi operation can be reduced in the same manner.

In a conventional technique, a work machine having an unload valve controls the flow rate with the differential pressure for the unloading fluctuated with respect to movement of the spool (an opening area of the spool) of the control valve in a case of a slightly-moving operation (an unload area).

That is, in the conventional technique, the operation cannot be controlled in proportion to the opening area of the spool of the control valve in the slightly-moving operation (the unload area); however, in the hydraulic system according to the embodiment of the present invention, the control valve 40 controls the differential pressure between in front of and behind a main spool to be constant by using the spring 51, and in this manner, the hydraulic system is capable of supplying a flow rate to the hydraulic actuator in proportion to the opening area of the spool even in the unload area.

Even in the solo operation where the turn motor MT is solely operated (without operating other control valve), the flow rate outputted from the flow rate prioritizing part 42F can be set to be constant. That is, even in the solo operation, the operation fluid can be supplied preferentially from the second direction switch part 41F toward the turn motor MT.

In the embodiment, the turn control valve 40F is exemplified as a second control valve having the second direction switch part and the flow rate prioritizing part. The second control valve however may be other control valves. For example, the hydraulic system may include a control valve (auxiliary control valve) configured to control a hydraulic actuator of an auxiliary attachment (an operation tool referred to as a first hydraulic actuator or a second hydraulic actuator), and the auxiliary control valve may be employed as the second control valve. In this manner, in a case where the auxiliary attachment is disposed on a tip end of the arm 12 for example, the operation fluid can be supplied preferentially to the auxiliary attachment, and thus the auxiliary attachment can be operated stably.

In addition, the travel control valve configured to control the travel device may be employed as the second control valve. In this manner, the operation fluid can be supplied preferentially to the travel device, and thus the travel device can be operated stably.

According to the embodiment described above, even in the configuration having the pressure compensation part, the operation fluid can be supplied preferentially to a preliminarily determined hydraulic actuator.

In the above description, the embodiment of the present invention has been explained. However, all the features of the embodiments disclosed in this application should be considered just as examples, and the embodiments do not restrict the present invention accordingly. A scope of the present invention is shown not in the above-described embodiments but in claims, and is intended to include all modifications within and equivalent to a scope of the claims.

Obviously, numerous modifications and variations of the present invention are possible in light of the above teachings. It is therefore to be understood that within the scope of the appended claims, the invention may be practiced otherwise than as specifically described herein.

What is claimed is:

1. A hydraulic system for a work machine, comprising:
a first hydraulic actuator;
a second hydraulic actuator;
a hydraulic pump to supply an operation fluid;
a first control valve to control the first hydraulic actuator, the first control valve comprising:
a first direction switch to switch a direction in which the operation fluid is to flow through the first hydraulic actuator; and
a pressure compensator to maintain a differential pressure to a constant pressure, the differential pressure being a difference between a pressure of the operation fluid to be inputted to the pressure compensator and a pressure of the operation fluid to be outputted from the pressure compensator; and
a second control valve to control the second hydraulic actuator, the second control valve comprising:
a second direction switch to switch a direction in which the operation fluid is to flow through the second hydraulic actuator; and
a flow rate prioritizer to prioritize a flow rate of the operation fluid to be outputted to the second hydraulic actuator,
wherein the flow rate prioritizer includes:
a spool configured to move between a first position where a flow rate of the operation fluid outputted to the second hydraulic actuator is increased and a second position where the operation fluid of a flow rate smaller than the flow rate at the first position is supplied to the second hydraulic actuator;
a pressing member to press the spool toward the first position;
a first pressure receptor to receive a pressure of the operation fluid outputted from the second direction switch to the flow rate prioritizer; and
a second pressure receptor to receive a pressure of the operation fluid outputted from the hydraulic pump, and
wherein the spool includes a first flow path with a throttle to decrease the flow rate of the operation fluid to less than the flow rate at the first position when the spool is at the second position and a second flow path without the throttle when the spool is at the first position, the spool being configured to be pressed toward the first position by a pressing force of the pressing member and by the pressure of the operation fluid received by the first pressure receptor such that the operation fluid is to flow toward the second hydraulic actuator via the second flow path, and is pressed toward the second position by the pressure of the operation fluid received by the second pressure receptor such that the operation fluid is to flow toward the second hydraulic actuator via the first flow path.

2. The hydraulic system according to claim 1, comprising:
a first fluid tube connected to the hydraulic pump;
a second fluid tube connecting the second direction switch to the first pressure receptor; and
a third fluid tube connecting the first fluid tube to the second pressure receptor.

3. The hydraulic system for the work machine according to claim 1, wherein the second hydraulic actuator is a turn motor.

4. The hydraulic system for the work machine according to claim 1, wherein the second hydraulic actuator is a travel motor.

5. The hydraulic system for the work machine according to claim 1, wherein the second hydraulic actuator is an auxiliary attachment attachable to the work machine.

6. The hydraulic system for the work machine according to claim 1, wherein
the first hydraulic actuator includes
an arm cylinder, or
a boom cylinder.

7. The hydraulic system for the work machine according to claim 1, wherein the first hydraulic actuator includes a travel motor.

8. The hydraulic system according to claim 1,
wherein the pressing force of the pressing member is set to equal to or less than a differential pressure between an output pressure of the operation fluid outputted from the hydraulic pump and a highest one of load pressures of the first control valve and the second control valve.

9. The hydraulic system according to claim 1,
wherein the spool is configured to increase the flow rate of the operation fluid as compared with a flow rate of the operation fluid at an intermediate position when the spool is at the first position and to decrease the flow rate of the operation fluid as compared with the flow rate of the operation fluid at the intermediate position when the spool is at the second position.

10. The hydraulic system according to claim 1, wherein the spool is configured such that the flow rate of the operation fluid outputted to the second hydraulic actuator when the spool is at the second position is greater than zero.

11. A hydraulic system for a work machine, comprising:

a first hydraulic actuator;

a second hydraulic actuator;

a hydraulic pump to supply an operation fluid;

a first control valve to control the first hydraulic actuator, the first control valve comprising:

a first direction switch to switch a direction in which the operation fluid is to flow through the first hydraulic actuator; and a pressure compensator to maintain a differential pressure to a constant pressure, the differential pressure being a difference between a pressure of the operation fluid to be inputted to the pressure compensator and a pressure of the operation fluid to be outputted from the pressure compensator; and a second control valve to control the second hydraulic actuator, the second control valve comprising:

a second direction switch to switch a direction in which the operation fluid is to flow through the second hydraulic actuator; and a flow rate prioritizer to prioritize a flow rate of the operation fluid to be outputted to the second hydraulic actuator, wherein the flow rate prioritizer includes:

a spool configured to move between a first position where a flow rate of the operation fluid outputted to the second hydraulic actuator is increased and a second position where the operation fluid of a flow rate smaller than the flow rate at the first position is supplied to the second hydraulic actuator;

a pressing member to press the spool toward the first position;

a first pressure receptor to receive a pressure of the operation fluid outputted from the second direction switch to the flow rate prioritizer; and a second pressure receptor to receive a pressure of the operation fluid outputted from the hydraulic pump, wherein the spool is configured to be pressed toward the first position by a pressing force of the pressing member and by the pressure of the operation fluid received by the first pressure receptor, and is pressed toward the second position by the pressure of the operation fluid received by the second pressure receptor, and wherein the spool is configured such that the flow rate of the operation fluid outputted to the second hydraulic actuator when the spool is at the second position is greater than zero.

* * * * *